United States Patent [19]

Sato

[11] 4,073,234

[45] Feb. 14, 1978

[54] PRINTING MACHINE FOR LABEL STRIP, OR THE LIKE

[75] Inventor: Yo Sato, Tokyo, Japan

[73] Assignee: Kabushiki Kaisha Sato Kenkyusho, Tokyo, Japan

[21] Appl. No.: 678,760

[22] Filed: Apr. 21, 1976

[30] Foreign Application Priority Data

Apr. 26, 1975 Japan ..... 50-050220

[51] Int. Cl.[2] ..... B41F 1/08

[52] U.S. Cl. ..... 101/288; 156/384; 101/292

[58] Field of Search ..... 101/66, 69, 288, 291, 101/292, 287, 226, 321, 228, 90; 197/133 R; 156/384–387

[56] References Cited

U.S. PATENT DOCUMENTS

| | | | |
|---|---|---|---|
| 923,085 | 5/1909 | Smith | 101/90 |
| 2,264,647 | 12/1941 | Stearns | 101/288 X |
| 2,671,397 | 3/1954 | Gorbatenko | 101/228 |
| 2,696,784 | 12/1954 | Geiler | 101/292 |
| 2,791,175 | 5/1957 | Sohn | 101/228 |
| 3,256,813 | 6/1966 | Casey | 101/292 |
| 3,908,544 | 9/1975 | Seidl et al. | 101/292 |

*Primary Examiner*—Edward M. Coven

*Attorney, Agent, or Firm*—Ostrolenk, Faber, Gerb & Soffen

[57] ABSTRACT

A printing machine for printing information on a label strip, or the like, which machine comprises: a holder for supporting a rolled label strip; a printing device for printing information on the label strip; a platen for pressing the label strip against the type face of the printing device; an advancing device which advances the label strip toward the printing device; and a winding device to wind the printed label strip. The printing machine of this invention is able to print indicia, such as bar code characters, clearly and quickly.

7 Claims, 19 Drawing Figures

PRINTING MACHINE FOR LABEL STRIP, OR THE LIKE

BACKGROUND OF THE INVENTION

This invention relates to a printing machine, which is used for printing desired information, such as bar codes, on a strip of labels, tickets, tags or the like. The printing machine is preferably portable and desk type.

In known label printing systems, prices, shop numbers, production dates, and other information about various commodities are printed on labels, tickets, tags, or the like (hereinafter referred to as labels) by printing machines installed in supermarkets or department stores. The printed labels are attached to the commodities to be sold. The printed labels provide information to the customers about commodities to be purchased and also provide information to the store clerks for counting and totalizing of commodities. When they are capable of being read with the naked eye, the accuracy and clarity of printed indicia are regarded as satisfactory for the above purposes.

In recent years, a computerized POS (point of sale) system has been adopted in large supermarkets for foods and other household goods. Information about the commodities being sold is indicated by bar codes imprinted directly on the casings, boxes or bags of commodities, or on labels which are attached to the commodities to be sold. The bar code system was developed mainly for what is called source marking, where the bar codes are directly printed on boxes and bags as they are produced.

Each character of a bar code is represented by two parallel dark bars and two light spaces, and a bar code is assembled by arranging the bars and spaces in side-by-side relation. In the symbol marks of the Universal Product Codes established by American Supermarket Institute, the required length of a dark bar is about 23 mm, the breadth of one character is 2.311 mm and the tolerance of the breadth of the character is $\pm$ 0.096 mm. Hence, a code must be printed with precision.

The bar codes appearing on the commodities are optically read when the goods are purchased. This performs useful purposes in the administration of sales, inventory and store managing. In order to read the bar codes with an optical character reading means, the bar codes must be printed precisely.

Since factories can install precise and large-scale printing machines for a source marking system, they can do precise bar code printing. However, it is impractical to install large printing machines for printing bar codes in shop fronts and supermarkets. Therefore, label printing machines which are able to print bar codes on labels in a store and attach the printed labels to commodities in the store are eagerly desired.

In known printing machines of this type, the outside of a cylindrical drum carries types for printing several bar code characters. The drum is rotated to shift the desired type to the print position. The type is then pressed against a label strip. A carbon-polyethylene ribbon is interposed between the type and the label strip. A length of the carbon-polyethylene ribbon of the same length as the label is consumed in every printing. The above type of printing machine is not widely used, because it has the following disadvantages:

a. Printing speed is low.
b. Printing cost is high.

c. Large logical circuits and driving members are required for rotating and selecting a drum at every printing.
d. The size and weight of the machine are quite large and the machine cannot be easily carried.
e. The printing machine is expensive.

As a result of the foregoing problems, bar code printing at stores and shops was tried using the conventional printing machines that are used for printing the prices and other information about commodities on the labels for the commodities. However, precise printing of bar codes on the label strips was not attainable with these conventional machines.

BRIEF SUMMARY OF THE INVENTION

It is the primary object of the present invention to provide a portable, small size printing machine for precisely printing indicia on label strips.

Another object of the present invention is to provide a printing machine which is able to print bar codes on label strips, rapidly and with great precision.

Yet another object of the present invention is to provide a printing machine with a simple operating mechanism.

A further object of the present invention is to provide a printing machine in which the printed label strip can be easily wound.

Still a further object of the present invention is to provide a printing machine in which a winding device for winding a printed label strip can be both mechanically and electrically connected to the body of the printing machine in a single operation.

To realize the above objects, a printing machine according to the present invention comprises: a holder for supporting a rolled label strip; a printing device for printing desired indicia on the label strip; a platen for supporting and pressing the label strip against the type face of the printing device; and an advancing device for advancing the label strip a distance of one label length in each printing cycle.

The printing machine has a detachable winding device for winding a printed label strip. The winding device includes a reel which is rotated by a motive power source through a friction clutch. Furthermore, the mechanical connection and electrical connections to the winding device are simultaneously established when the winding device is attached to the printing machine.

BRIEF DESCRIPTION OF THE DRAWINGS

The foregoing and other objects and features of the present invention will become apparent from the following description taken in conjunction with the accompanying drawings, in which.

DETAILED DESCRIPTION OF THE PREFERRED EMBODIMENT

Figure 15:
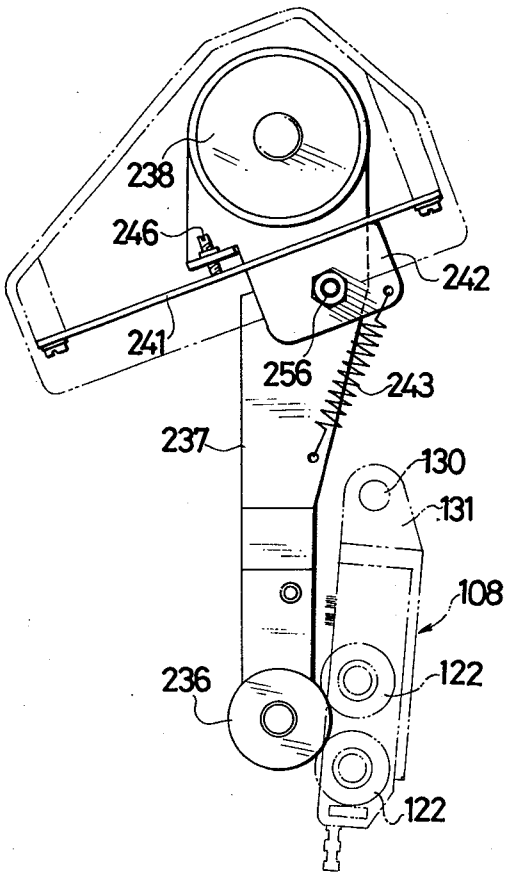
FIG. 15 is a side view of the inking device and ink supplying device shown in FIG. 14.

Referring to the accompanying drawings, an embodiment of the invention is now described. The complete machine is described with reference to FIG. 1; a printing device, is described with reference to FIG. 2; an inking device, platen lifting device, strip advancing device and their driving mechanism, with reference to FIGS. 2, 3, 4, 5, 6, 7 and 8; the advancing of a label strip, to FIGS. 9, 10, 11 and 12; a cutting device, to FIG. 13; an ink supplying device, to FIGS. 14 and 15; and a strip winding device, to FIGS. 16, 17, 18 and 19.

The Complete Machine

Figure 1:
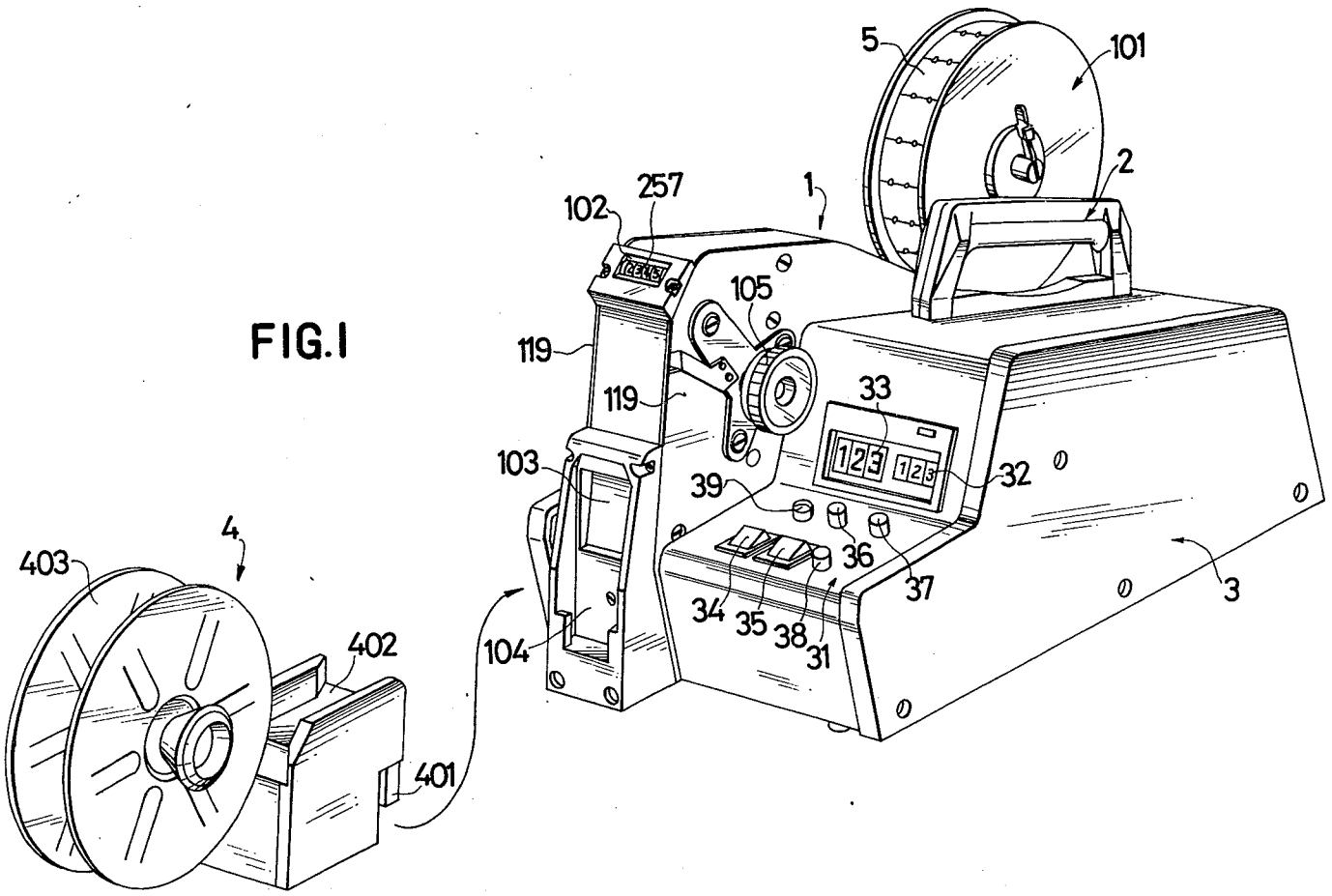
FIG. 1 is a perspective view of an embodiment of the present invention.

Referring to FIG. 1, the apparatus comprises a printing machine 1 for printing a label strip or the like, a winding device 4 detachably mounted on the printing machine 1 and a controlling section 3. The printing machine 1 and the controlling section 3 are integrally attached side-by-side. A grip 2 is fixed to the controlling section 3 by which this combination can be carried.

The controlling section 3 has an operating panel 31 which is provided with a set counter 32 for setting the quantity of labels to be printed, an indicator 33 for indicating the number of labels thus far printed, a power switch 34, a change-over switch 35 for changing between manual and automatic operations, an operation starting button 36, a reset button 37, an operation stop button 38 and a pilot lamp 39 for a power source.

On the rear portion of the printing machine 1, there is mounted a reel 101 which carries a rolled, blank label strip 5. A sight window 102 is formed on the front portion of the printing machine 1. The indicia 257 to be printed can be observed through the window 102. Below the sight window 102 is a delivery opening 103 through which a printed label strip 5' is delivered. A strip winding device attaching slot 104 is formed beneath the opening 103. A strip winding device 4 is detachably secured to slot 104. A label printing device 106, of the type shown in my copending application Ser. No. 678,761, filed Apr. 21, 1976, entitled "Printing Heads for Portable Labeling Machine, or the Like" is employed. A knob 105 is attached on the side wall of printing machine 1. This knob 105 is laterally slidable on its support axis and is rotated for selecting the type 107 to be printed.

The strip winding device 4 is provided with an attaching piece 401 which is received in the attaching slot 104 of the printing machine 1. A guide channel 402 is formed above the attaching piece 401. Channel 402 receives the label strip that is delivered from the delivery opening 103. A reel 403 in front of the guide channel 402 has the printed label strip 5' wound around it manually or automatically.

Printing Machine

Figure 2:
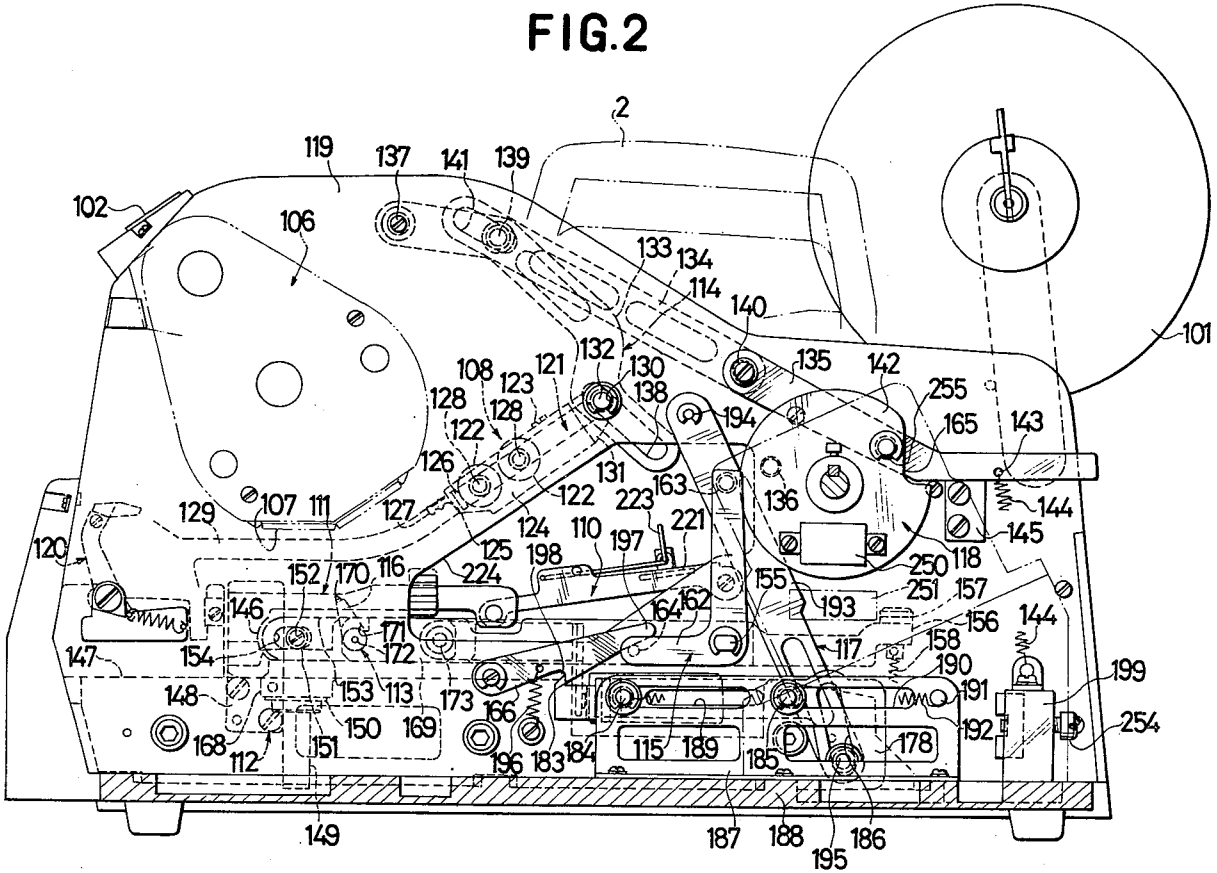
FIG. 2 is a side elevational, cross sectional view of the printing machine with the controlling section of the machine removed.

Referring to FIG. 2, the printing machine 1 comprises a printing device 106 which is mounted on the machine frame 119 for printing bar codes on the label strip 5, an inking device 108 for applying ink to the bar code type face 107' of the printing device 106, an ink supplying device 109 (cf. FIG. 14) for supplying ink to the inking device 108, a reel 101 for carrying the rolled label strip 5 to be printed, a label strip guiding device 110 for guiding the label strip 5 from the reel 101 to a position under the printing device 106, a platen 111 for raising and pressing the part of the label strip 5 under the printing device 106 against the bar code type face 107', a platen lifting device 112 for vertically moving the platen 111, a label strip advancing device 113 for moving the label strip 5 over one label length at each printing operation, a cutting device 120 for cutting a printed label strip 5' from the blank strip 5 at a desired point, a first link mechanism 114 for reciprocating the inking device 108, a second link mechanism 115 for vertically moving the platen 111 by means of the platen lifting device 112, a third link mechanism 117 for reciprocating the advancing pawl 116 of the label strip advancing device 113 forwardly and backwardly, and a cam mechanism 118 for driving in sequence the first, second and third link mechanisms.

The application of ink to the bar code types, the printing on the label strip and the advancing of the label strip are performed by a single rotation of the cam 142 of the cam mechanism 118. When the magnet 250 attached on the cam 142 makes a single revolution with cam 142, a relay 251 is actuated by the magnet 250 to indicate the completion of a cycle and to cause appropriate below described action.

Inking Device, Platen Lifting Device, Advancing Device and Mechanisms for Driving These Devices Referring to FIGS. 2, 3, 4, 5, 6, 7 and 8, the means that drives all of the below described devices is the generally circular rotatable cam 142 which has a generally circular profile but has a notched recess 165 provided for reasons described below.

The inking device 108 comprises inking rollers 122 and a brush 123 which are replaceably fitted into a holder 121. The inking rollers 122 are of the cartridge type. The lugs 126 of the inking rollers 122 are fitted in the slots 125 that are formed in the side walls 124 of the holder 121. When the inking rollers 122 are to be detached, a pinch piece 127 is pulled, and this pushes apart the side walls 124, widening slots 125 and enabling removal of the rollers 122.

Like the inking rollers 122, the brush 123 is replaceably attached to holder 121. The brush follows the movement of inking rollers 122. After every inking of the inking rollers 122, the brush 123 cleans the faces, bevels and counters of the selected bar code types 107, which are arranged to form the type face 107'. The brush 123 is formed from hairs having diameters smaller than the dark bar or light space of a bar code and the hairs are set in bunches. Since great precision in the bar thicknesses in bar codes is required, the brushing of the types removes all residue which might interfere with bar code appearance.

Rollers 128 are pivotally mounted on the outsides of the side walls 124 of the holder 121. The rollers 128 are separate from inking rollers 122. Rollers 128 are in engagement with the elongated guide grooves 129 that are formed on the machine frames 119. The inking device 108 is accurately guided in its movement along the guide grooves 129.

On the side of the holder 121 opposite the pinch piece 127, lugs 131 having holes 130 therein are formed. A rocking shaft 132 is inserted into the holes 130.

The inking device 108 is reciprocatingly moved along grooves 129 by means of the roller 136, which is attached on the cam mechanism 118 engaging and coacting with the first link mechanism 114. Link mechanism 114 is comprised of links 133 and 134 and a lever 135, with identical sets of such elements at opposite sides of the frames 119. The upper, left hand ends of the links 133 are pivotally attached to the upper portions of machine frames 119 by fixed pins 137. At the other ends of the links 133 are formed the elongated slots 138. Slots 138 provide play to accommodate the pivotal motion of links 133 while inking device 108 moves more in a straight line. Intermediate the fixed pins 137 and the slots 138, the spaced apart links 133 are joined together by a shaft 139.

Figure 3:
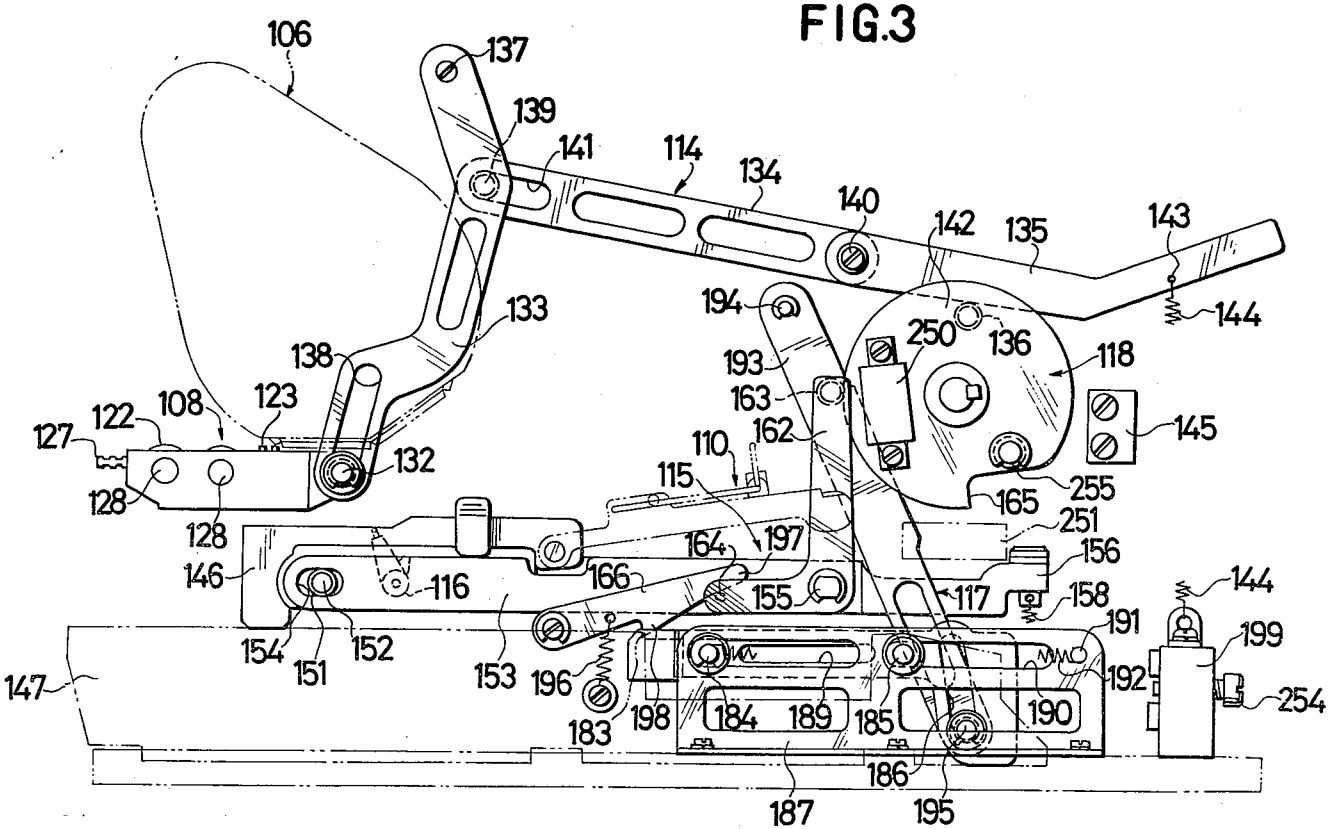
FIG. 3 is a side view of the parts of the printing machine involved in the application of ink to a printing device.
Figure 4:
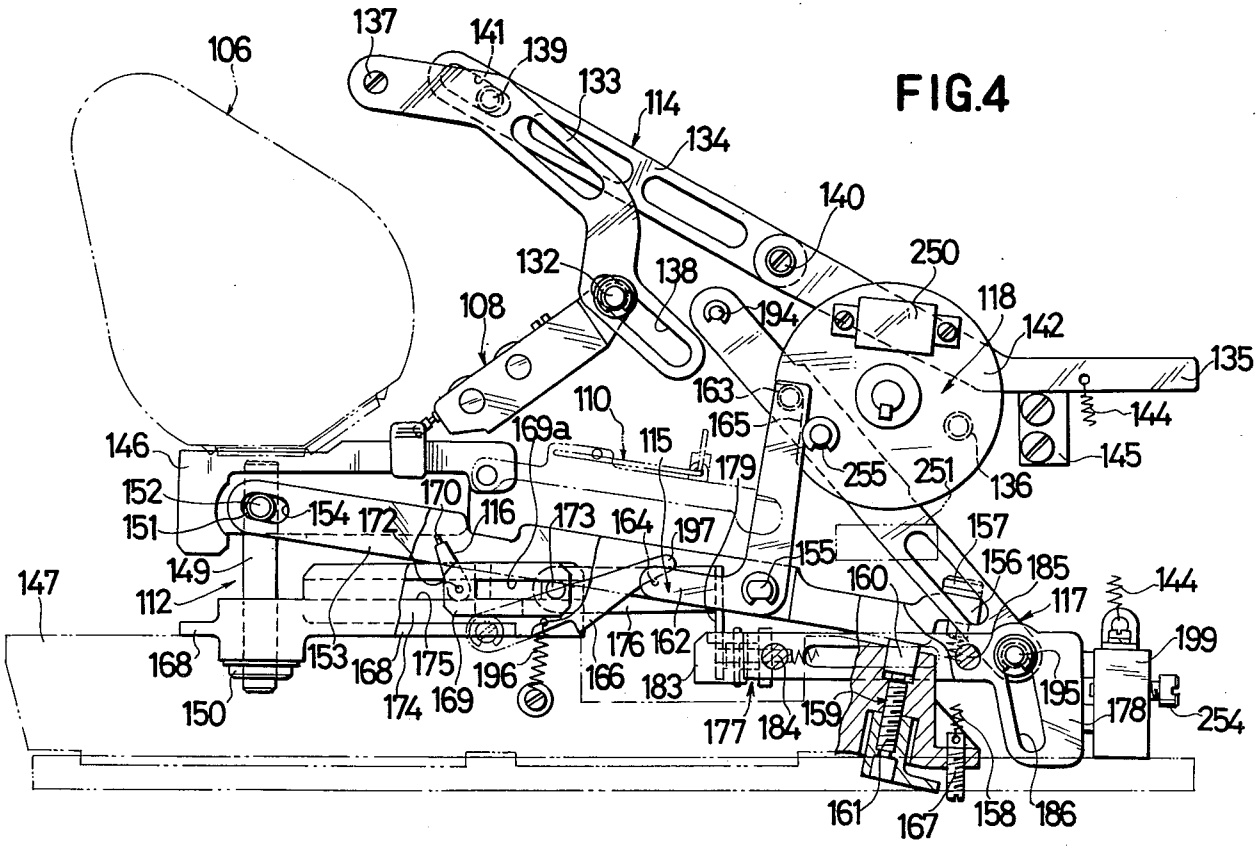
FIG. 4 is a view of the printing machine similar to that of FIG. 3, in which a platen is pressed against the printing device.

The links 134 and the lever 135 are rigidly affixed together to move together. They are pivotally attached to a shaft 140 that is affixed in frames 119. Those ends of the links 134 that are near to the links 133 are formed with slots 141, in which the shaft 139, which is attached to the links 133, is inserted. Slots 141 allow play to accommodate the differing directions of motion of links 134 and 133. (Cf. FIGS. 3 and 4.)

The lever 135 extends rearwardly of the machine 1 along the side of the cam 142. The rear end of the lever 135 projects beyond the machine frames 119. Near its rear end, the lever 135 has a hole 143, from which a tensioned coil spring 144 is suspended. In this manner, the lever 135 is normally urged clockwise. The lowest or most clockwise position to which the lever 135 may be pivoted is fixed by the upper surface of a stopper 145 that is attached to the side wall of a machine frame 119. The underside of the lever 135 between the fixed pivot shaft 140 and the hole 143 is normally urged by spring 144 to a position within the range of rotational motion of the roller 136 that is pivotally supported on the cam 142. When the cam 142 is rotated, the under side of the lever 135 is lifted up by the roller 136 and this turns the lever 135 counterclockwise against the force of the spring 144.

After the roller 136 is rotated clockwise past its uppermost position by the cam 142, the lever 135 is pivoted clockwise by spring 144 until it is stopped by the stopper 145 with the underside of lever 135 resting on the upper surface of the stopper 145. Thereafter, the contact between the lever 135 and the roller 136 is discontinued until the next rotational cycle. In a single rotational cycle, the links 134 are rocked about the fixed shaft 140, through the sequence shown in FIGS. 2–5. With such rocking motion, the links 133 are also moved. In this manner, the inking device 108 is reciprocated along the guide grooves 129. Reciprocation of the inking device 108 causes the bar code type faces 107' to be inked by the inking rollers 122 and causes the types to be cleaned by the brush 123.

Figure 6:
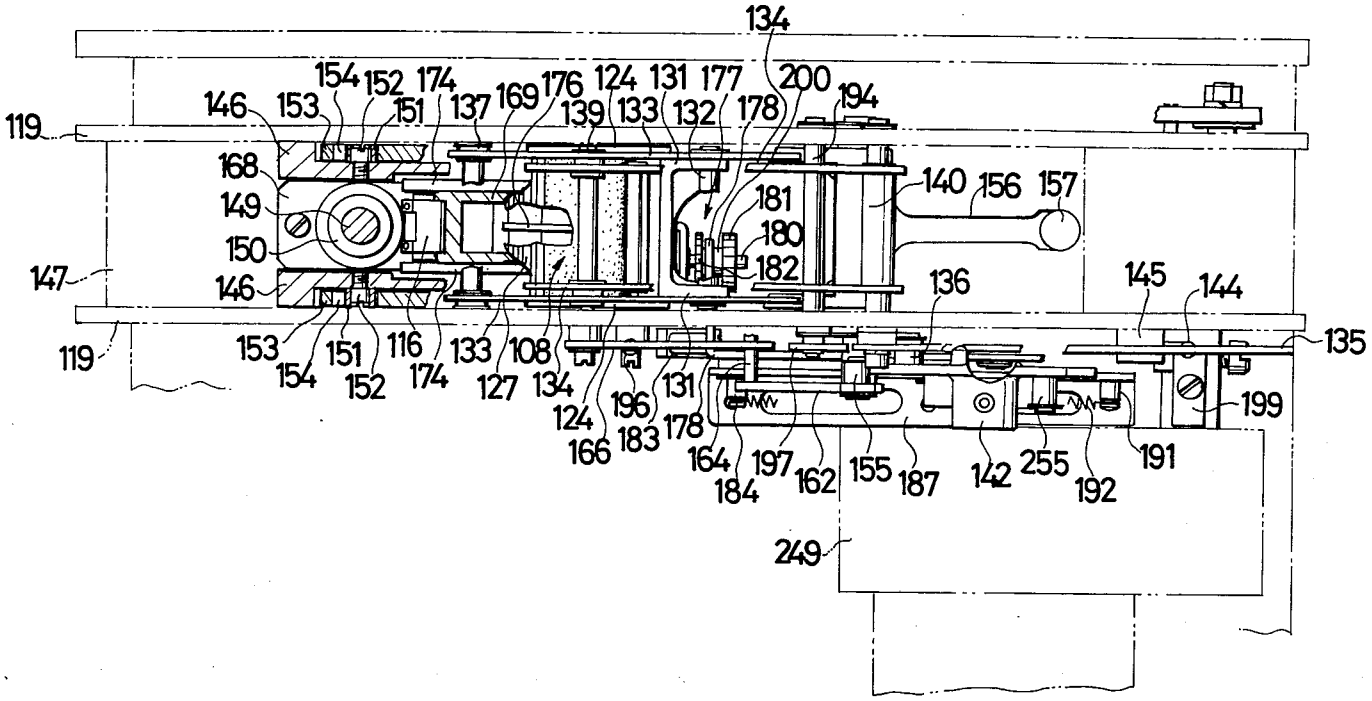
FIG. 6 is a top plan view of the main part of the printing machine.
Figure 8:
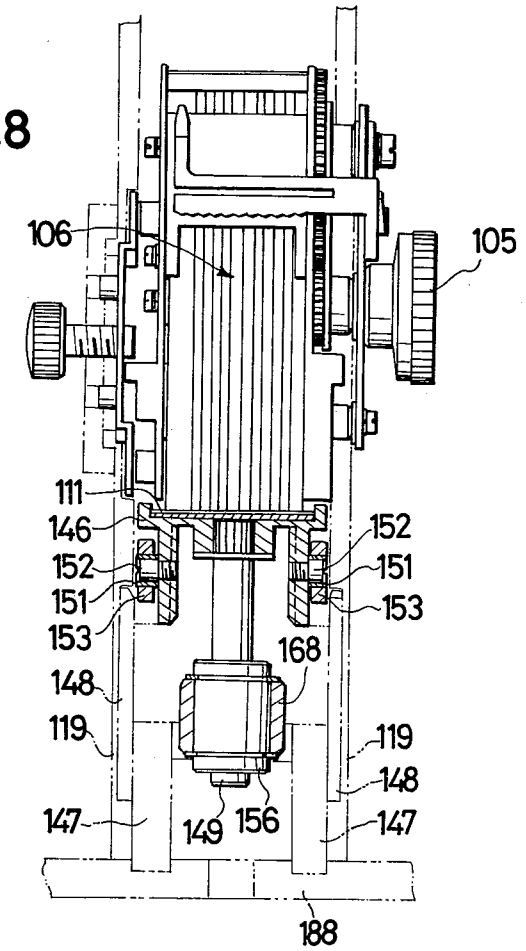
FIG. 8 is a view of the printing machine similar to that of FIG. 7, in which the platen is pressed against the printing device.
Figure 7:
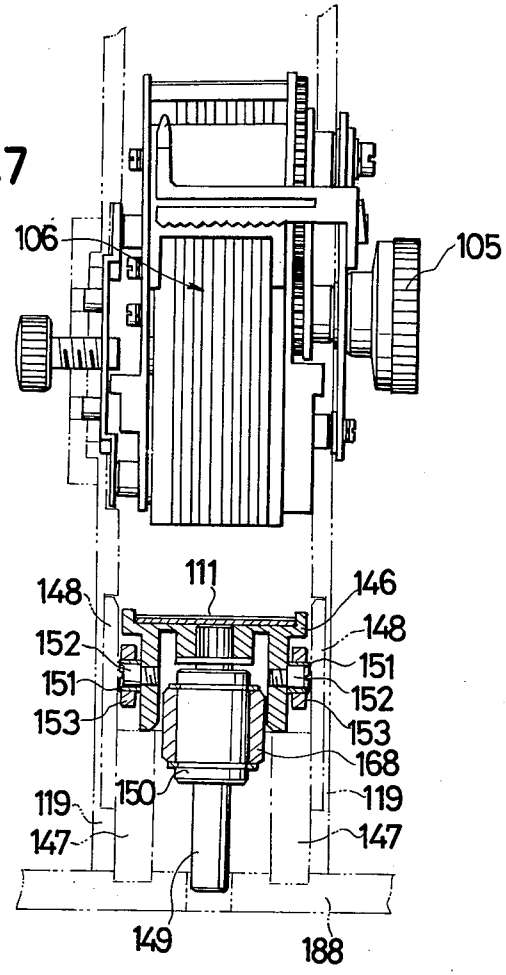
FIG. 7 is a front elevational view of the printing machine showing the relationship among the printing device, a platen and a platen lifting device.
Figure 9:
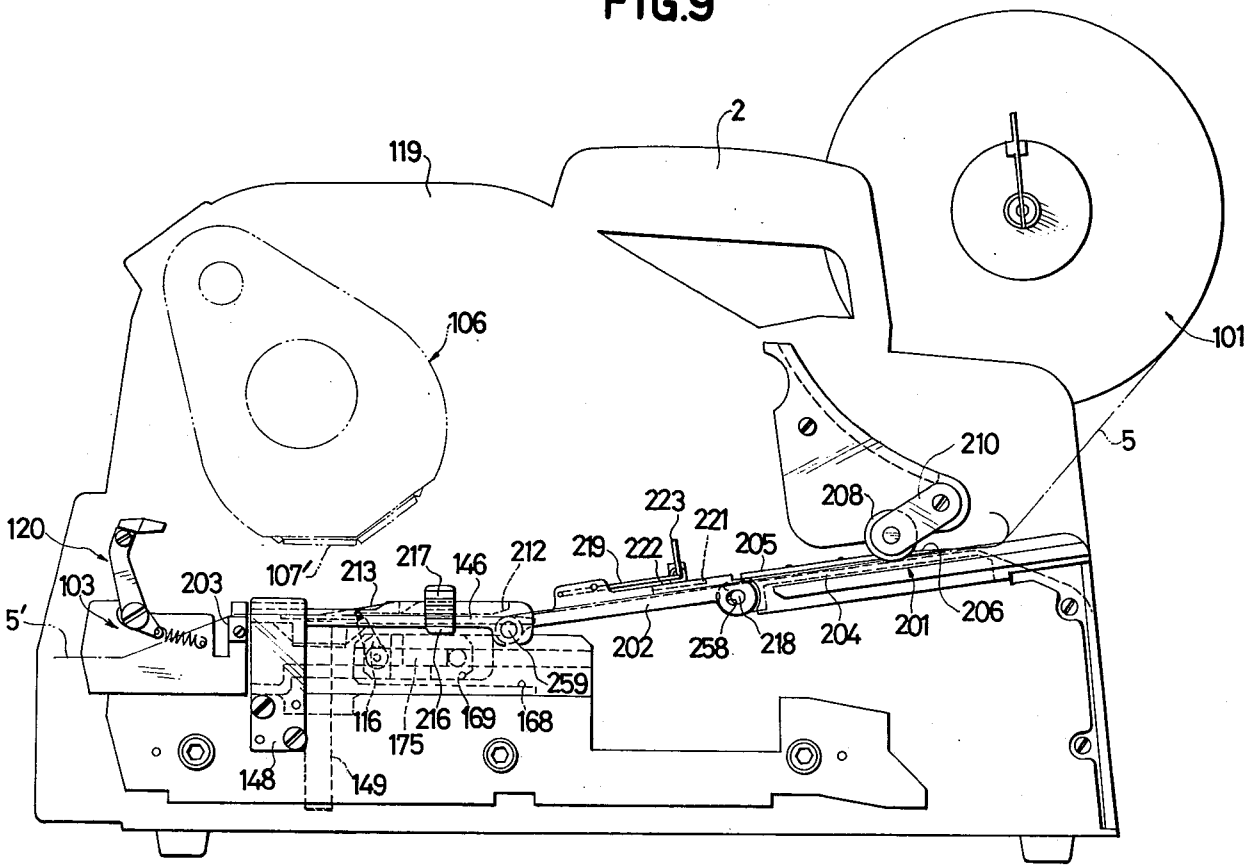
FIG. 9 is a side view of the printing machine showing the main portion of the passage for the label strip.
Figure 10:
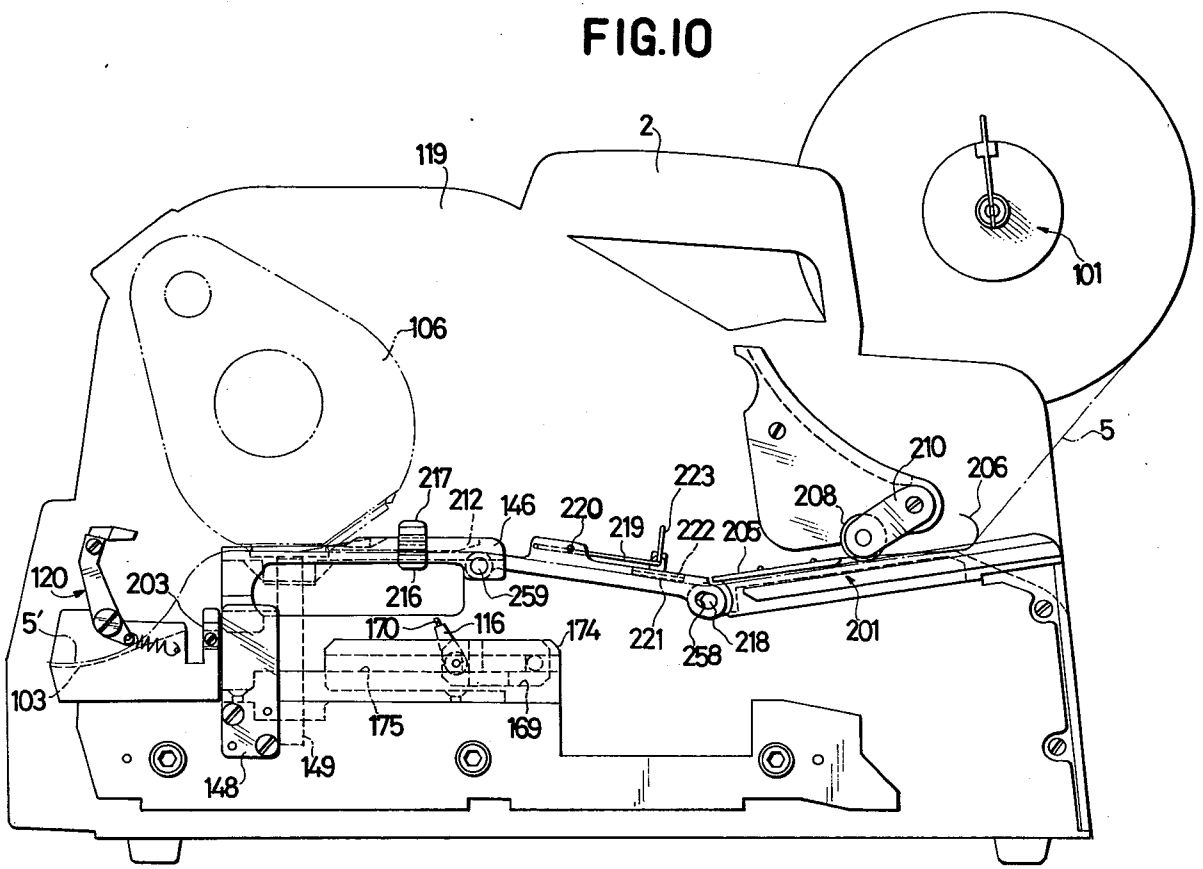
FIG. 10 is a view similar to that of FIG. 9, in which the platen is pressed against the printing device.
Figure 12:
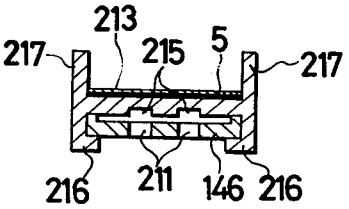
FIG. 12 is a cross-sectional view of the passage taken along the line XII in FIG. 11.
Figure 11:
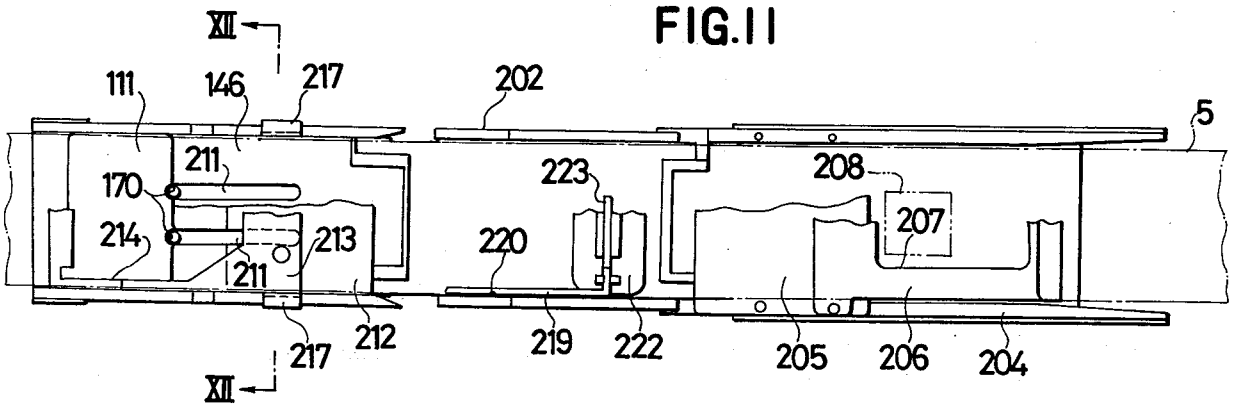
FIG. 11 is a partly cut-away plan view of the main portion of the passage for the label strip.

As shown in FIGS. 6, 7 and 8, the platen 111 is fixedly carried on a positioning bed 146. Referring to FIG. 6, the lower middle portion of the positioning bed 146 is cut out and the rear lower parts of bed 146 on both sides thereof are cut away. The under surface of bed 14 is received on the base 147 attached to the machine frames 119. The uncut surfaces at both sides of the front portion of bed 146 are guided for vertical reciprocation by guide plates 148 attached to the base 147. A post 149 is affixed on the underside of the positioning bed 146, below the middle of the type face 107'. The post guides the vertical movement of bed 146. The post 149 passes through a bearing 150 without lateral play. Bearing 150 is carried by a supporting memeber 168 that is attached to the base 147. Since the post 149 moves without play through bearing 150, the positioning bed 146 and platen 111 also move vertically without play.

Those cut-away portions of bed 146 at the lateral sides of post 149 carry projecting pins 152 (FIG. 6), each of which supports a respective roller 151. The interconnected platen 111, positioning bed 146 and post 149 are all vertically moved together by the motion of the second link mechanism 115 with which the rollers 151 are in engagement.

Link mechanism 115 is now described. It comprises two identical sets of elements spaced apart in the machine. Elongated slots 154, which receive the platen bed rollers 151, are formed at the front portions of links 153. The slots 154 are elongated to accommodate the different types of motion of bed 146 and links 153. The rear portions of the links 153 are pivotally attached to the machine frames 119 by a fixed shaft 155. On the links 153 to the rear of the fixed shaft 155, a lever 156 is integrally formed. At the rear end of the lever 156 is attached an engaging piece 157, which is urged in the clockwise direction around the fixed shaft 155 by tension spring 158. A supporting screw 167 (FIG. 4) is attached to the base 147 below the lever 156 and the screw 167 holds the lower end of the spring 158. Adjusting of the position of screw 167 varies the tension of spring 158. The base 147 under the lever 156 is provided with an adjusting device 159 for controlling the lower stop position of the lever 156. The adjusting device 159 includes the screw 161 which is attached to the base 147. Screw 161 engages the resting face 160 of the lever 156 and by this engagement, the screw determines the stop position of the lever 156. By adjustment of the tension of the spring 158 and by adjustment of the screw 161 of the adjusting device 159, the angle and force of turning of the lever 156 and links 153 can be adjusted. In this manner, the pressure of platen 111 against the type face 107' is controlled.

The fixed shaft 155 extends to the machine frame 119 on the side of the controlling section 3. A bell crank 162 is integrally attached to the shaft 155. The upper end of the vertical arm of the bell crank 162 has a roller 163 pivotally attached to it. The front end of the horizontal arm of the bell crank is provided with a pin 164. The pin 164 functions in the advancing of the label strip, as described below. The roller 163 is in engagement with the outer surface of the cam 142. The bell crank 162 is rocked by its roller 163 moving into and then out of the recess 165 of the cam 142. With this rocking motion, the lever 156 and links 153, under the tension of spring 158, are rocked. Thus, the platen 111 is pressed against the type face 107'. After the roller 163 on bell crank 162 has been received within the recess 165 of the cam 142, the bell crank 162 is pushed back to its former position by the roller 255 on the side of cam 142 and by the outer surface of the cam 142. Meanwhile, the pin 164 attached to the bell crank 162 raises the tip 197 of below described hook 166 and this keeps the label strip advancing pawl 116 at the advanced position.

The label strip advancing pawl 116 is attached to the pin 172 and this pin is attached to the front portion of holder 169. The tip ends 170 of the pawl 116 are urged clockwise by a spring (not shown) so as to be directed upwardly. The pawl 116 is supported by an inclined surface 171 (FIG. 2) which is part of the holder 169. The position of this inclined surface 171 is adjusted in the forward and backward directions (not shown) so as to control the inclination of the label strip advancing pawl 116. The holder 169 has a shaft 173 (FIGS. 2 and 5) at its rear portion and has rectangular projections **169*a* (FIG. 5) on both of its sides. Holder guide plates 174 (FIGS. 4–6) are spaced apart and are integral with the supporting member 168. Plates 174 are provided with guide grooves 175, which receive the rectangular projections 169*a* of the holder 169 and guide the holder 169** in horizontal, longitudinal motion.

The holder 169 and the advancing pawl 116 it carries are reciprocated horizontally by the third link mechanism 117. The holder 169 is connected to the third link mechanism 117 by a pawl feed lever 176 (FIG. 6), pawl feed position adjusting device 177 and another pawl feed lever 178. The end portion of the pawl feed lever 176 opposite to the holder 169 is bent to form a bent down portion 179, which is provided with a bolt 180 (FIG. 6). An adjusting member 182 is screwed onto bolt 180 and then the pawl feed lever 178 is loosely fitted on bolt 180. Next, a knob 181 having a neck portion 200 is screwed onto the bolt 180. Now, the pawl feed lever 178, which is loosely fitted on the bolt 180, is tightly held between the screwed on adjusting member 182 and the knob 181. The position of the bolt 180 is moved by loosening the screws of adjusting member 182 or knob 181. This correspondingly positions the pawl feed lever 176, the holder 169 and the label strip advancing pawl 116.

The pawl feed lever 178 extends outside the machine frame 119 on the side of the controlling section 3 (FIG. 6). Once outside frame 119, the pawl feed lever 178 is bent rearwardly and runs parallel to the machine frame 119 (FIGS. 5 and 6) in the portion that is under the roller 136 that is pivotally attached to the cam 142. Near the adjusting member 182, the pawl feed lever 178 is provided with a catch piece 183 which is engageable with the pawl 198 of the hook 166. A pin 184 projects from the side of the lever 178 toward the controlling section 3 and pin 184 is movable with lever 178. Another similar pin 185 is fixed on a portion of the lever 178 below the cam 142.

Figure 5:
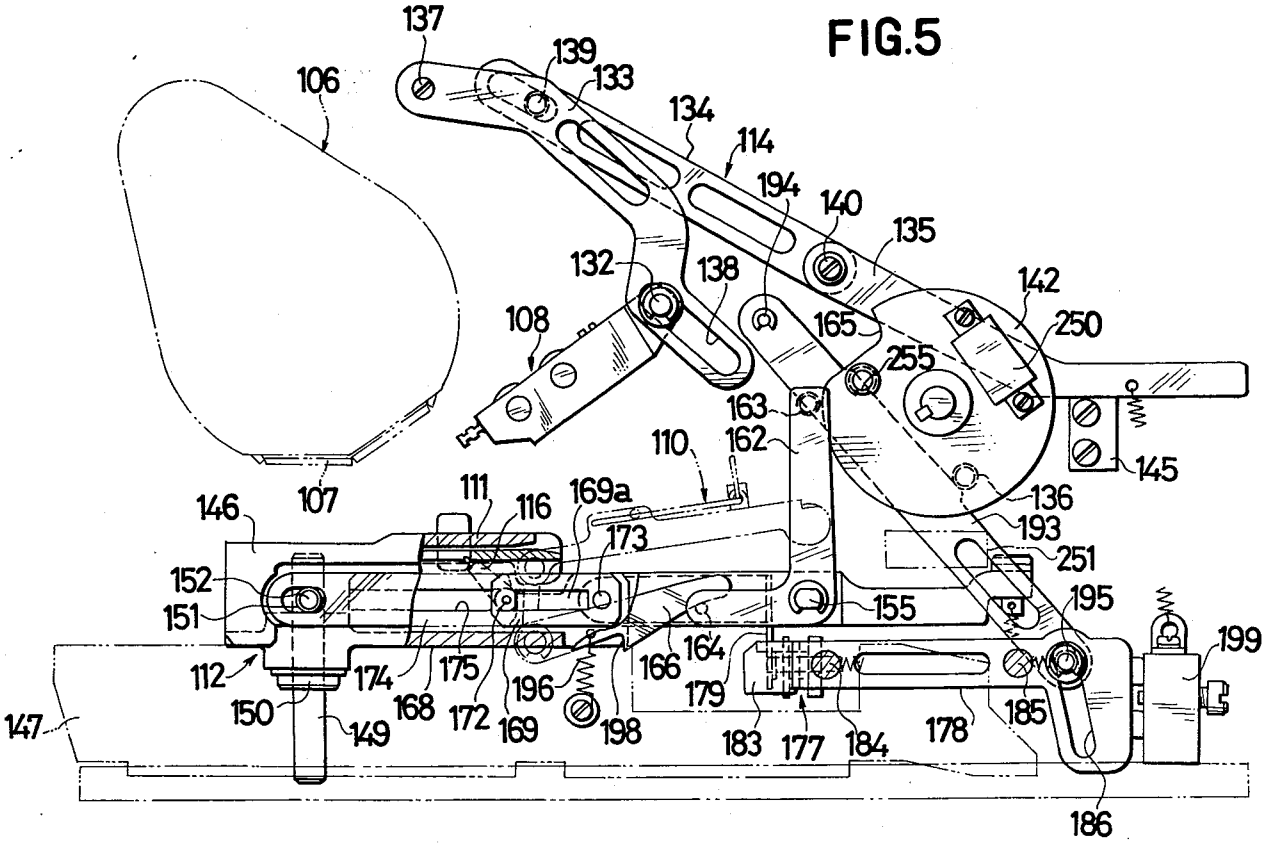
FIG. 5 is a view of the printing machine similar to that of FIG. 3, showing the condition of the machine as advancing of a label strip begins just after the printing of a label.

Lever 178 has a downwardly depending rear portion (FIG. 5). Near the pin 185, an inclined slot 186 is formed in the rear portion of lever 178. A guide plate 187 for guiding the pawl feed lever 178 is fixed to a base plate 188 (FIGS. 2, 3, 7 and 8). Slots 189 and 190 are formed in the guide plate 187 for receiving the pin 194 and the pin 185, respectively. By this pin in slot engagement, the pawl feed lever 178 is guided for motion in the horizontal, longitudinal direction. Rearwardly of the slot 190, a pin 191 (FIG. 3) is fixed on guide plate 187. A coil tension spring 192 is attached between stationary pin 191 and feed lever pin 184. Thus, the pawl feed lever 178 is pulled to the right in the direction to retract the label advancing pawl 116.

The upper end of a link 193 (FIGS. 2–5) is pivoted to the machine frame 119 by a fixedly located shaft 194. There is a pin 195 at the lower end of link 193, which pin is inserted in the slot 186 of the pawl feed lever 178. The middle portion of the link 193 is positioned within the range of a part of the rotational motion of the roller 136 of the cam 142.

The above-mentioned hook 166 (FIGS. 2–6) is pivotally attached at an unnumbered pivot at the left of hook 166 to the machine frame 119. Hook 166 is urged down or clockwise by a coil spring 196. The right hand, free tip end 197 of the hook 166 engages the pin 164 of the bell crank 162. With the movement of the pin 164 and the bell crank, the hook 166 is rocked. When the pawl 198 is in engagement with the catch piece 183, the retraction of pawl feed lever 178 by the force of coil spring 192 is prevented. The motion of the bell crank 162, timed by cam 142 and its recess 165, thus controls the engagement of pawl 198 and catch piece 183.

When the tip end 197 of the hook 166 is pushed up by the pin 164 of the bell crank 162, which is caused by the pivoting of the bell crank 162 under the influence of the rotation of the cam 142, the pawl 198 is released from the catch piece 183. Thus, the pawl feed lever 178 is retracted by the force of coil spring 192 which accompanies the retraction of the advancing pawl 116. When the link 193 is engaged and then pushed by the roller 136 on the clockwise rotating cam 142, the link 193 is rocked clockwise on the shaft 194. The pawl feed lever 178 is pushed by the pin 195 at the lower end of link 193 in the direction of the hook 166. Thus the advancing pawl 116 is moved forward. The translational motion of pin 195 is absorbed by its moving through slot 186. Further, due to advance of feed lever 178, the pawl 198 is caught by the catch piece 183. The subsequent retraction of the pawl feed lever 178 and its interlocked parts can be prevented until the hook 166 is lifted.

The furthest retracted position of the pawl feed lever 178 is established by adjusting the screw 254 of a rear positioning member 199 (FIGS. 2, 3 and 5). The lower end of the coil spring 144 is attached on the upper face of the positioning member 199. This pulls down the lever 135 of the first link mechanism 114.

Passage for the Label Strip

Referring to FIGS. 9, 10, 11 and 12, the label strip passage comprises a first guide frame 201 for guiding the label strip 5 as it is fed from the reel 101, another guide frame 202 for guiding the label strip 5 from the first guide frame 201 to the positioning bed 146 and the positioning bed 146 which is moved vertically relative to the bar code type face 107' of the printing device 106. The printed label strip 5' fed off the positioning bed 146 is led over the lower blade 203 of the cutting device 120 and from the cutting device to a delivery opening 103.

The lower frame 204 of the guide frame 201 is fixed to the machine frames 119. Frame 204 has an upper side that carries a label strip guide 205 and a slack preventing leaf spring 206. The middle portion of the leaf spring 206 above the guide 205 is cut out to form a window 207. The rear, right hand portion of the spring is curved around forwardly so as to facilitate the passage of the label strip 5 and to relieve the tension of the label strip 5 that is caused when it is abruptly stretched. A non-reversing roller 208 having a one directional (clockwise in FIG. 9) rotary clutch is pressed downwardly through the window 207 toward the upper surface of the lower frame 204. When the label strip 5 is inserted beneath spring 206, a knob 209, which is coaxial with the roller 208 and is exposed on the side of a machine frame 119, is turned. The roller 208 is attached to the machine frames 119 by a lever 210 that is pivotally connected on frame 119. The lever 210 usually urges roller 208 down to the lower frame 204 under the influence of a spring (not shown).

As described above, the middle portion of the positioning bed 146 is cut out and the bed 146 is supported by the post 149 so as to be moved vertically. Under the bar code type face 107' to be printed, the platen 111 is attached to the positioning bed 146. Slots 211 are formed in the rear portion of the platen 111. At the rear portion of platen 111, a label strip hold down member 212 is attached. A rebound leaf spring 213 is fitted over the hold down member 212. Spring 213 extends to the platen 111. Leaf spring 213 is cut out at its portion above the platen 111 to form a window 214, through which the label strip 5 placed on the platen 111 is printed.

The tip ends 170 of label strip advancing pawl 116 project up through the slots 211. The tip ends 170 engage the perforations of the portion of the label strip 5 that is being carried between the positioning bed 146 and the hold down member 212. The hold down member 212 above the slots 211 has grooves 215 in its lower surface which grooves are aligned with the slots 211 and receive the tip ends 170 of the label strip advancing pawl 116. This enables the engagement between the tip ends 170 and the perforations of label strip 5.

At both sides of the middle portion of hold down member 212, engaging pieces 216 are formed on the lower sides of member 212 and a pair of holding lugs 217 are formed on the upper sides of member 212. The hold down member 212 is attached to the positioning bed 146 by means of the engaging pieces 216 fitting over the edges of bed 146. Member 212 is attached to and can be disengaged from the positioning bed 146 by pinching the holding lugs 217. Therefore, different label strip hold down members 212 can be selected according to the width of the label strip 5.

At the rear end of the positioning bed 146, the guide frame 202 is pivotally connected to bed 146 by means of a pivot shaft 259. Slots 258 are formed in the rear end of guide frame 202. The shaft 218 that is attached to the guide frame 201 passes through the slots 258 thereby connecting the guide frames. The slots 258 provide sufficient play between guide frames 201, 202 that the positioning bed 146 can be moved vertically.

Above the guide frame 202, a felt holder spring 219 is pivoted on projections 220. The position of spring 219 is determined by projections 220. A holder plate 222 having a sheet of felt 221 applied on its underside, is detachably secured at the free end of the spring 219. The felt 221 removes the foreign substances such as paper waste and talc used in the paper manufacture from the surface of the label strip 5. The holder plate 222 is provided with a handle 223 on its upper side. When the holder plate 222 and/or the felt 221 thereon are changed, the handle 223 is pulled up by an operator inserting his hand through the window 224 (FIG. 2) formed on the frame 119. The engagement of the holder plate 222 with the projections 220 is released.

Cutting Device

Figure 13:
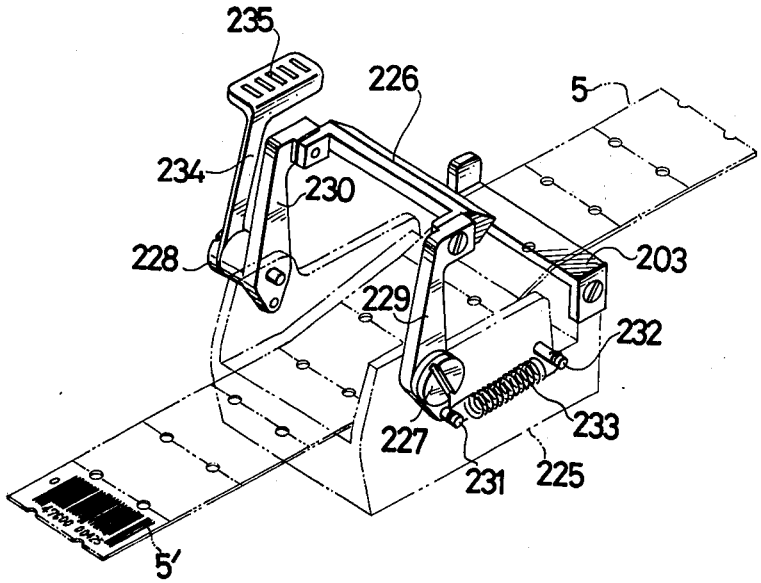
FIG. 13 is a perspective view of a cutting device which is used with the printing machine.
Figure 14:
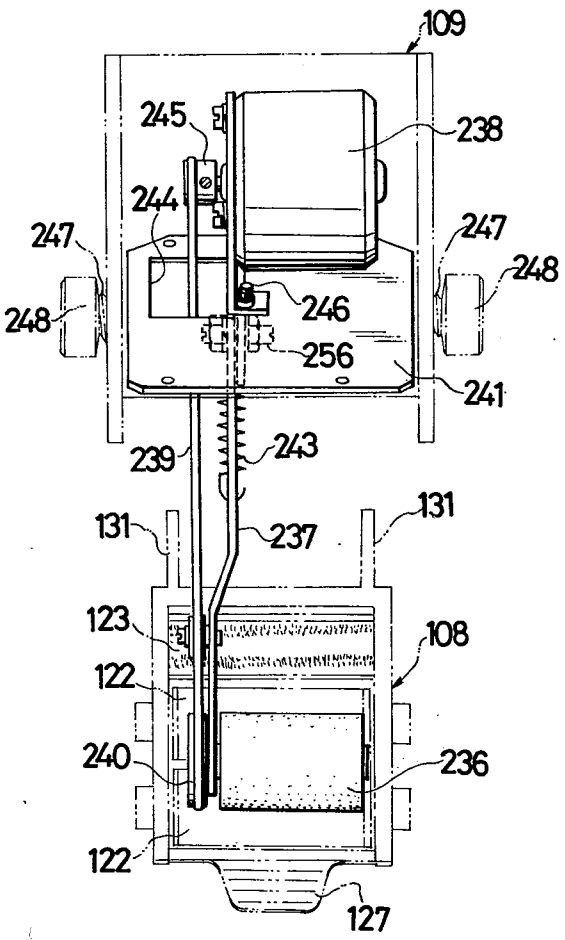
FIG. 14 is a plan view of an inking device and an ink supplying device used with the printing machine.
Figure 17:
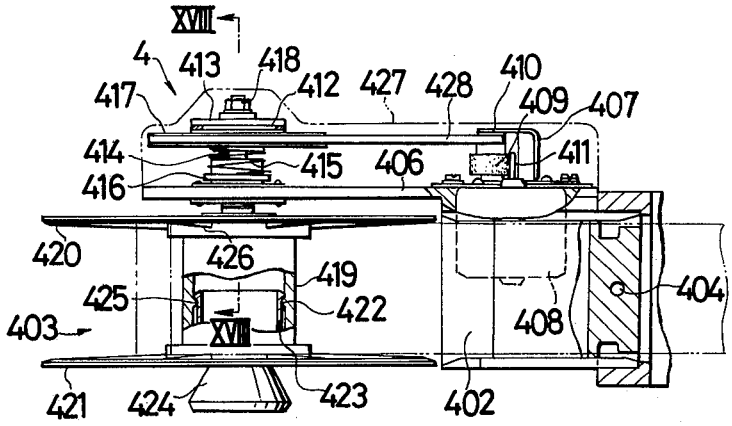
FIG. 17 is a partly cut away plan view of the label strip winding device.
Figure 16:
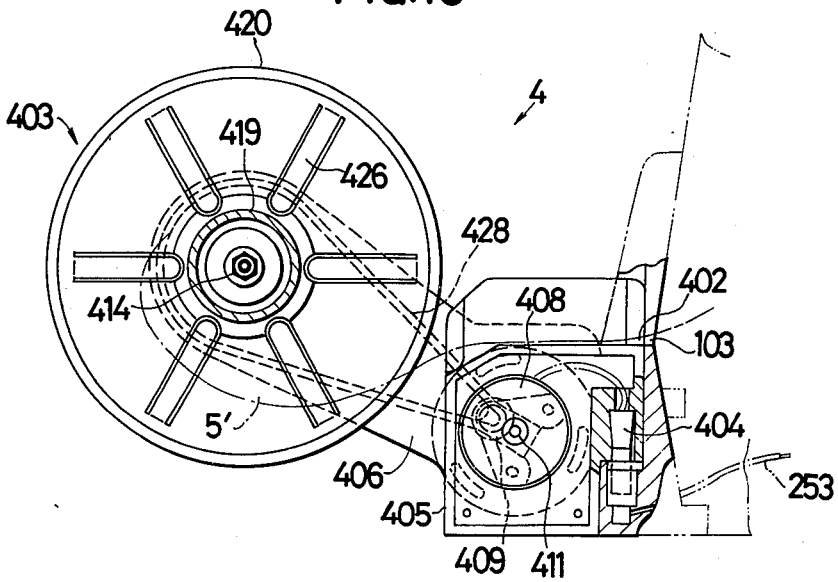
FIG. 16 is a cross-sectional elevational view of a label strip winding device taken on its center line.
Figure 18:
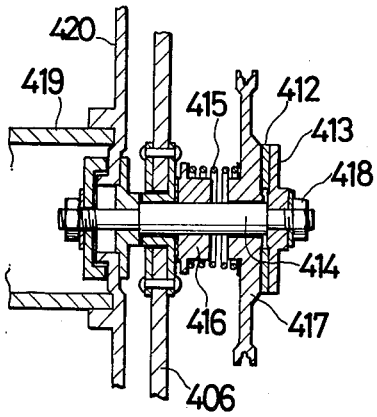
FIG. 18 is a cross sectional view of the shaft portion of the label strip winding device taken on the line XVIII in FIG. 17.
Figure 19:
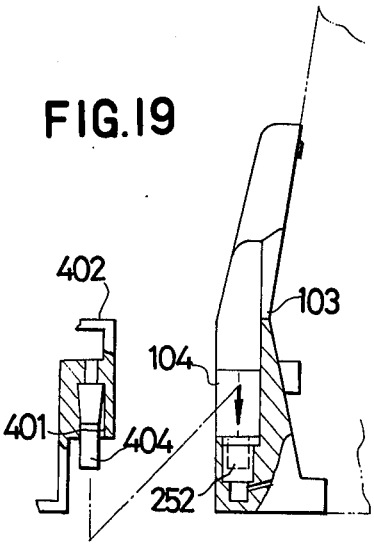
FIG. 19 is a partly cut away side view of the connecting portions of the printing machine and the label strip winding device.

Referring to FIG. 13, there is a support frame 225 for the cutting device. A lower blade 203 is attached to a portion of the frame 225 near the positioning bed 146. An upper blade 226 is attached to rocking levers 229 and 230 which are pivoted to the frame 225 by means of the respective pins 227 and 228. The rocking lever 229 extends down from blade 226 beyond the pin 227. A pin 231 projects sideways from the extended portion of lever 229. Another pin 232 is attached to the frame 225. A tensioned coil spring 233 extends between the pins 232 and 231, thereby urging the lever 229 counterclockwise. The rocking lever 230 is provided with an integral operation rod 234. By manually rocking down the head 235 of the operating rod 234, the rocking levers 229 and 230 are pivoted around the pins 227 and 228 against the tension of the coil spring 233. The edge of the upper blade 226 is pressed toward the edge of the lower blade 203 so as to cut the printed label strip 5'. The rocking levers 229 and 230 are positioned inside the machine frames 119 while the operating rod 234 is positioned outside the frame 119 on the side thereof opposite to the controlling section 3 so as to be available to be operated easily.

Ink Supplying Device

The printing of the bar codes must be done precisely. It is necessary to apply ink uniformly on the inking rollers 122. The ink supplying device of FIGS. 14 and 15 applies ink uniformly on the inking rollers 122. The device comprises: an ink supplying roller 236, a rocking frame 237 which carries the ink supplying rollers 236 pivotally connected at one end of frame 237, a motor 238 and a belt 239 for transmitting the rotation of motor 238 to the ink supplying roller 236. When the inking device 108 is retracted and stopped, the ink supplying roller 236 rests between the inking rollers 122.

On the outside of the rocking frame 237, the ink supplying roller 236 is provided with a coaxial pulley 240. The rocking frame 237 is pivotally attached to a lug 242 of a fixed plate 241 by a screw 256 and the frame is urged counterclockwise in FIG. 15 by a spring 243 that is stretched between the rocking frame 237 and the lug 242. An electric motor 238 is attached to the rocking frame 237 and fixed plate 241 is interposed between motor 238 and frame 237.

A window 244 is formed in the fixed plate 241. Rocking plate 237 passes through window 244. The endless belt 239 extends through window 244 between the pulley 240 on roller 236 and the pulley 245 on the motor 238. By this means, the ink supplying roller 236 is continuously rotated by the motor 238.

The rocking frame 237 carries a screw 246 which engages the fixed plate 241. The pressure of the ink supplying roller 236 against the inking rollers 122 is regulated by rotation of the screw 246. In this manner, excessive pressure of the ink supplying roller 236 against the inking rollers 122 can be prevented.

The ink supplying device is detachably fixed to the machine frames 119 by bolts 247 having manually operable knobs 248. Thus, the replacement of the ink supplying roller 236 can be easily carried out.

Label Strip Winding Device

Referring to FIGS. 16, 17, 18 and 19, the label strip winding device 4 is detachably mounted on the printing machine 1. The printing machine 1 is provided with an attaching slot 104 beneath the label strip delivery opening 103. The winding device attaching piece 401 is formed below the label strip guide channel 402 of the winding device 4. In order to make an electrical connection of the winding device simultaneously with the mechanical attachment of the winding device 4 to the printing machine 1, the attaching slot 104 is provided with a socket 252, from which electric wires 253 are introduced into the controlling section 3.

The winding device 4 includes a cooperating electric plug 404 in the attaching piece 401. The locations of the socket and the plug can be exchanged as between machine 1 and winding device 4. The frame body 405 forms the label strip guide channel 402. Body 405 is provided on one side face with a frame member 406 and a U-shaped member 407 is attached to another side of the frame body 405. A motor 408 is built in the frame body 405. A rubber roller 409 and a coaxial rotatable pulley 410 are pivotally attached to the U-shaped member 407. The drive shaft 411 of the motor 408 is moved into frictional contact with the rubber roller 409 and the rotating shaft 411 drives the roller 409 and the pulley 410. The other end of the frame member 406 is provided with a label strip winding reel 403 and a coaxial shaft 414 supporting reel 403. Shaft 414 has a clutch plate 413 with a felt member 412 at its end. The shaft 414 additionally carries a disk 416 which supports a compression coil spring 415 on one side thereof. At its other side, spring 415 presses upon pulley 417. A pulley 417 is interposed between the disk 416 and the clutch plate 413. An endless belt 428 is fitted between the pulley 417 and the other pulley 410 at the motor. This transmits the rotation of the motor 408 to the pulley 417. The coil spring 415 presses the side face of the pulley 417 against the surface of felt member 412. Thus, the rotation of the pulley 417 is transmitted to the clutch plate 413. When a selected degree of force to retard its rotation is applied to the clutch plate 413, the clutch plate 413, the shaft 414 attached to the clutch plate 413 and the reel 403 are not rotated. However, the pulley 417 continues to rotate as the contact surfaces slip together. The degree of slippage depends upon the spring force of the coil spring 415. This can be regulated by adjusting the nut 418 which draws shaft 414 out of pulley 417. The frame member 406 and the elements carried thereon are enclosed by cover 427.

The reel 403 comprises a cylindrical tubular shaft 419 and side plates 420 and 421. The side plate 420 and the shaft 419 are securely affixed to the shaft 414. Radially inwardly extending projections 422 are formed on the inner surface of the cylindrical shaft 419 near the side plate 421. The side plate 421 is provided with a cylinder 423 which is sized to extend into and engage the interior walls of shaft 419 and this fits the plate 421 to the shaft 419. At the other side of plate 421, concentric with shaft 419, there is a knob 424. The circumferential surface of the cylinder 423 has recesses 425 so placed that when the cylinder 423 is fitted into the shaft 419, the side plate 421 is fixed to the shaft 419 by the engagement between the recesses 425 and the projections 422.

The opposed surfaces of the side plates 420 and 421 carry respective leaf springs 426, which are attached near the peripheries of the side plates 420 and 421 and gradually bend toward each other as they extend radially inwardly. The distance between the free radially inward ends of both leaf springs 426 is narrower than the breadth of the label strip 5'. Thus, at the start of the winding, the label strip 5' is caught between the leaf springs 426 on the side plate 420 and the leaf springs 426 on the side plate 421.

The label strip 5' is wound on the shaft 419 by rotation of the reel 403. When a predetermined tension is imparted to the label strip 5' after it has been wound on the shaft 419, slippage occurs between the pulley 417 and the felt member 412. Rotation of the reel 403 then ceases.

Operation

A rolled label strip 5 is attached to the reel 101. The front end of the strip 5 is introduced into the clearance space between the lower frame 204 and the leaf spring 206. The label strip 5 is then passed under the non-reversing roller 208. By rotation of the knob 209, The label strip 5 is advanced by the roller 208 to the felt 221. Then an operator inserts his hand through the window 224 of the machine frame 119 and pulls up the handle 223 together with the spring 219 and felt 221. The label strip 5 is passed under the felt 221 and into the space between the positioning bed 146 and the hold down member 212. Then the label strip 5 is passed between the platen 111 and the rebound spring 213, thereby setting the label strip for printing.

While the operator watches the indicia 257 through the sight window 102, the bar code types 107 are selected by rotating the knob 105.

Further, the label strip winding device 4 is mechanically and electrically attached to the printing machine 1 by inserting the attaching piece 401 into the attaching slot 104.

The changeover switch 35 is switched to cause manual operation, the power switch 34 is turned on and the starting button 36 is pushed so as to perform a trial printing on the label strip 5. If this trial printing gives a satisfactory result with desired accuracy, the changeover switch 35 is switched to automatic operation, and this drives the electric motor 408 of the label strip winding device 4 and rotates the reel 403. Then the desired number of bar code labels to be printed is set on the set counter 32. Automatic printing is started by pushing the start button 36.

The front end of printed label strip 5' of a certain length can be automatically wound on the cylindrical shaft 419 by putting the front end between the leaf springs 426 of the reel 403. The springs will draw the strip 5' along as the reel rotates.

When it is desired to stop the automatic printing partway through a count, for example, in case the precision of the printing becomes unsatisfactory, further printing is stopped by pushing the stop button 38. Once the number of labels that has been set on the set counter 32 has been printed, further printing is automatically stopped. The number of labels that has been printed is indicated on the indicator 33. When the number appearing on the indicator 33 is to be reset, the reset button 37 is depressed.

After the desired number of labels has been printed, the power switch 34 is turned off and the head 235 on the operation rod 234 of cutting device 120 is pushed down so as to cut the printed label strip 5' from the blank label strip 5. Then the side plate 421 of the reel 403 is taken off and the printed label strip 5' is removed from the cylindrical shaft 419.

The operation of the printing machine 1 is now described. When the label strip 5 is loaded and the cam 142 is rotated by the drive of motor 249, the lever 135 is raised by the roller 136 on the cam 142. The links 134 are moved by the turning of the lever 135. The links 133 in engagement with the slots 141 of the links 134 by shaft 139, pivot on the fixed shaft 137. During this movement, the links 133 push forward the rocking shaft 132 which has the slots 138. This moves the inking device 108 below the printing device 106.

The rollers 128 attached on both sides of the holder 121 are guided in the guide grooves 129. The inking rollers 122 of the inking device 108 move past and apply ink to the type face 107'. In the same sweeping motion of device 108, the brush 123 cleans the type face 107' (FIG. 3).

The roller 136 is rotated by cam 142 into engagement with and past lever 135, which pivots that lever around pivot 140. After the roller 136 passes the point at which it has raised the lever 135 to its highest level, the lever 135 begins to descend by pivoting clockwise under the tension of the spring 144. Upon this descent of lever 135, the inking device 108, links 133 and the other links 134 are moved back to the position shown in FIGS. 4 and 5. The cam 142 continues rotating. When the recess 165 of the cam 142 reaches the roller 163 of the bell crank 162, the bell crank 162, lever 156 and links 153 are all pivoted clockwise about the fixed shaft 155 under the influence of the tension spring 158. The links 153 raise the rollers 151 which have the slots 154. This vertically raises the positioning bed 146 and the platen 111 and the support post 149 for this is guided by the bearing 150. In this manner, the label strip 5 carried on the platen 111 is printed with bar codes. As the platen is raised, it also moves free of label strip advancing pawl 116, 170.

After the printing, further rotation of the cam 142 causes the roller 163 to be pushed from the recess 165. The bell crank 162, the lever 156 and the links 153 are all turned counterclockwise around the fixed shaft 155 against the force of the spring 158. In this manner, the platen 111 and the positioning bed 146 are lowered.

At the same time as the roller 163 of the bell crank 162 is being received in the recess 165 of the cam 142, the tip end 197 of the hook 166 is being raised by the pin 164 of the bell crank 162 against the force of the coil spring 196. By such action of hook 166, the pawl 198 of the hook 166 is released from the catch piece 183. This releases the pawl feed levers 176 and 178 to be moved backward by the coil spring 192. The holder 169 is also being retracted along the guide grooves 175. The label strip advancing pawl 116 is retracted for a distance greater than one label length along the slots 211. The pin 195 is moved rearward by the slots 186 with the movement of the pawl feed lever 178 as the link 193 is turned counterclockwise on the shaft 194.

When the roller 163 is pushed out of the recess 165 of the cam 142, the hook 166 is pulled clockwise and down by the coil spring 196 and the pawl 198 shifts into position to engage the catch piece 183. When the cam 142 is further rotated, the link 193 is turned clockwise by the pushing action of the roller 136. The pin 195 is moved forward in the slot 186 and it pushes the pawl feed lever 178 forward.

By such forward movement, the positioning bed 146 is fully lowered. The tip ends 170 of the label strip advancing pawl 116 are received through the slots 211. The label strip 5, which is held between the positioning bed 146 and the hold down member 212, is advanced by the engagement between the advancing pawl 116 and the perforations in the label strip 5. When the pawl feed lever 178 is fully advanced by the link 193 and the roller 136, the catch piece 183 engages the pawl 198 of the hook 166. Thus, the pawl feed lever 178 is kept at its advanced position until the hook 166 is pushed up by the pin 164 of the bell crank 162. The label strip advancing pawl 116 which is connected to the pawl feed lever 178 is also stopped at its forward position.

The relay 251 is actuated by the magnet 250 after a single rotation of the cam 142, which is the completion of one printing cycle. Under manual operation, the machine stops at the completion of a cycle until the starting button 38 is pushed. In automatic operation, the completed printing cycle is recorded in the indicator 33, while the next printing cycle is starting.

The present invention has the following advantages.

(1) Although the printing machine of the present invention is small sized and portable, precise printing on label strips can be performed.

(2) The printing of bar codes on label strips can be performed rapidly but precisely and at small cost.

(3) The printed label strips can be wound up.

(4) The winding device for winding a printed label strip can be simultaneously mechanically and electrically attached to and detached from the printing machine by a respective single operation.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A printing machine for feeding and printing labels, or the like, which are arranged in strip form, said machine comprising:

a machine body having a forward and a rearward end and having an exit and an entrance at said forward and said rearward ends, respectively;

a holder for a rolled strip of labels, or the like; said holder being mounted at said body rearward end near said entrance;

a passage for a label strip, said passage extending through said body from said rearward to said forward ends;

a printing device for printing indicia on labels, or the like; said printing device being supported in said body above said passage; types in said printing device facing toward said passage and defining a type face;

a platen in said body in opposed relationship to said type face and normally positioned below said passage; platen raising means connected with said platen for selectively raising said platen toward and against said type face and across said passage, and for thereafter lowering said platen to its said normal position;

a strip advancing device in said body for advancing the strip of labels, or the like, along said passage toward said body exit; said advancing device comprising a pawl projecting into said passage for engaging said strip, and reciprocating means for reciprocating said pawl along said passage;

means for coordinating the motion of said platen and said advancing device for causing said platen to shift to said type face while said pawl is not advancing the strip, for causing the pawl to retract rearwardly in said body while said platen is raised and for causing said pawl to advance the strip while said platen is in its said normal position;

a strip winding device for winding the strip of labels, or the like; said strip winding device being positioned near said body exit and being detachably mounted to said body; said winding device including a reel on which a strip may be wound; means for rotating said reel for winding the strip on it, and a friction clutch connection between said rotating means and said reel;

said rotating means for said reel is electrically operable, a connection to a source of electric power for said rotating means and said connection being located in said body; a mechanical socket, also having an electric socket associated with it and said mechanical and electric socket being together located on one of said body and said winding device; a mechanical plug and also having an electric plug associated with it being located on the other of said body and said winding device; said mechanical and electric sockets and plugs being connectable such that said winding device is mechanically connected with said body simultaneously as said rotation means is electrically connected with said body;

the one of said electric plug and said electric socket in said body being electrically connected with said connection to a source of electric power; the other of said electric plug and said electric socket in said winding device being electrically connected with said reel rotating means.

2. A printing machine for feeding and printing labels, or the like, which are arranged in strip form, said machine comprising:

a machine body having a forward and a rearward end and having an exit and an entrance at said forward and said rearward ends, respectively;

a holder for a rolled strip of labels, or the like; said holder being mounted at said body rearward end near said entrance;

a passage for a label strip, said passage extending through said body from said rearward to said forward ends;

a printing device for printing indicia on labels, or the like; said printing device being supported in said body above said passage; types in said printing device facing toward said passage and defining a type face;

a platen in said body in opposed relationship to said type face and normally positioned below said passage; platen raising means connected with said platen for selectively raising said platen toward and against said type face and across said passage, and for thereafter lowering said platen to its said normal position;

a strip advancing device in said body for advancing the strip of labels, or the like, along said passage toward said body exit; said advancing device comprising a pawl projecting into said passage for engaging said strip, and reciprocating means for reciprocating said pawl along said passage;

means for coordinating the motion of said platen and said advancing device for causing said platen to shift to said type face while said pawl is not advancing the strip, for causing the pawl to retract rearwardly in said body while said platen is raised and for causing said pawl to advance the strip while said platen is in its said normal position;

said platen raising means comprises a first link means connected to said platen and shiftable to raise and lower said platen;

said pawl reciprocating means comprises a second link means connected to said pawl and shiftable to advance and retract said pawl along said passage;

said coordinating means engaging and operating said first and said second link means to at a particular time raise said platen to said type face and at the same time to retract said pawl, and at a later time to lower said platen to its said normal position and at a still later time to advance said pawl;

said coordinating means comprises a rotatable cam and a pivot in said body on which said cam is rotatably mounted; means for rotating said cam;

first and second link engaging means on said cam and positioned thereof for periodically engaging said first and said second link means, respectively; said first and said second link means being positioned to be periodically engaged by said first and said second link engaging means, respectively;

said first and said second link engaging means of said coordinating means being so positioned on said cam such that said coordinating means causes said platen and said pawl to move in the recited sequence.

3. The printing machine of claim 2, wherein said first link means comprises a first pivotable link, a first pivot in said body on which said first pivotable link is pivotally mounted; said platen being connected to said first pivotable link to be pivoted thereby in a first pivot direction toward said type face and in a second pivot direction away from said type face;

said second link means comprising pawl shifting means to which said pawl is connected and for shifting and directing said pawl to move along said passage as said pawl reciprocates, and further comprising a second pivotable link connected with said pawl shifting means; a second pivot in said body on which said second pivotable link is pivotally mounted such that pivoting of said second link in a third pivot direction advances said pawl and pivoting of said second link in a fourth pivot direction retracts said pawl;

said first and said second link engaging means on said cam being so spaced apart and said first and said second links being so spaced apart that said platen and said pawl move in the recited sequence.

4. The printing machine of claim 3, wherein said coordinating means further comprises a hook attached in said body and shiftable between a hooking position at which said hook engages and holds said pawl shifting means against motion of said pawl and a free position at which said hook is free of said pawl and said pawl shifting means;

said second cam link engaging means engages said second link to pivot same in said third direction to urge said pawl forward in said body;

biasing means connected with said pawl shifting means for normally biasing said pawl rearward in said body, such that when said hook is in its said free position, said pawl is biased rearwardly in said body;

said hook and said first link being so positioned that upon said platen being pivoted in its said first direction, said first link moves into engagement with said hook to move said hook into its said free position.

5. A printing machine for feeding and printing labels, or the like, which are arranged in strip form, said machine comprising:

a machine body having a forward and a rearward end and having an exit and an entrance at said forward and said rearward ends, respectively;

a holder for a rolled strip of labels, or the like; said holder being mounted at said body rearward end near said entrance;

a passage for a label strip, said passage extending through said body from said rearward to said forward ends;

a printing device for printing indicia on labels, or the like; said printing device being supported in said body above said passage; types in said printing device facing toward said passage and defining a type face;

a platen in said body in opposed relationship to said type face and normally positioned below said passage; platen raising means connected with said platen for selectively raising said platen toward and against said type face and across said passage, and for thereafter lowering said platen to its said normal position;

a strip advancing device in said body for advancing the strip of labels, or the like, along said passage toward said body exit; said advancing device comprising a pawl projecting into said passage for engaging said strip, and reciprocating means for reciprocating said pawl along said passage;

means for coordinating the motion of said platen and said advancing device for causing said platen to shift to said type face while said pawl is not advancing the strip, for causing the pawl to retract rearwardly in said body while said platen is raised and for causing said pawl to advance the strip while said platen is in its said normal position;

an inking device for inking said type face; means for moving said inking device to said type face to ink said type face, and for moving said inking device away from said type face;

said coordinating means being connected with said means for moving said inking device so as to remove said inking device from said type face when said platen is moving against said type face;

said platen raising means comprises a first link means connected to said platen and shiftable to raise and lower said platen;

said pawl reciprocating means comprises a second link means connected to said pawl and shiftable to advance and retract said pawl along said passage;

said means for moving said inking device comprises a third link means connected to said inking device and shiftable to move said inking device in the recited manner;

said coordinating means engaging and operating said first, second and third link means to at a particular time raise said platen to said type face and at the same time to retract said pawl and move said inking device away from said type face, at a later time to lower said platen and to move said inking device to said type face, and at a still later time to advance said pawl, while said platen is at its said normal position;

said coordinating means comprises a rotatable cam and a pivot in said body on which said cam is rotatably mounted; means for rotating said cam; first, second and third link engaging means on said cam and positioned for periodically engaging said first, second and third link means, respectively; said first, second and third link means being positioned to be periodically engaged by said first, second and third link engaging means, respectively;

said first, second and third link engaging means being so positioned on said cam such that said coordinating means causes said platen, said pawl and said inking device to move in the recited sequence.

6. The printing machine of claim 5, wherein said first link means comprises a first pivotable link, a first pivot in said body on which said first pivotable link is pivotally mounted; said platen being connected to said first pivotable link to be pivoted thereby in a first pivot direction toward said type face and in a second pivot direction away from said type face;

said second link means comprising pawl shifting means to which said pawl is connected and for shifting and directing said pawl to move along said passage as said pawl reciprocates, and further comprising a second pivotable link connected with said pawl shifting means; a second pivot in said body on which said second pivotable link is pivotally mounted such that pivoting of said second link in a third pivot direction advances said pawl and pivoting of said second link in a fourth pivot direction retracts said pawl;

said third link means comprises a third pivotable link in said body and a third pivot in said body on which said third pivotable link is pivotable; an arm for supporting said inking device being connected with said third link; said inking device and its said arm being connected to said third pivotable link so as to move said inking device to said type upon pivoting of said third link in a fifth pivot direction and to move said inking device away from said type face upon pivoting of said third link in a sixth pivot direction;

said first, second and third link engaging means on said cam being so spaced apart and said first, second and third links being so spaced apart and being so positioned with respect to their respective said link engaging means that said platen, said pawl and said inking device move in the recited sequence.

7. The printing machine of claim 6, wherein said cam comprises a disk having an abutment that is formed thereon and is eccentric thereto and said abutment comprising both of said second and said third cam link engaging means;

said first cam link engaging means comprises a recess into the periphery of said cam; said recess being spaced from said cam abutment; said first link being in engagement with said periphery of said cam and upon rotation of said recess to said first link, said first link also then being in engagement with said recess; said second and third pivotable links being so positioned that upon rotation of said cam, said abutment engages said second and said third pivotable links and causes the same to shift as said abutment circularly rotates;

said first, second and third pivotable links being so arranged in sequence around said cam that said abutment first engages said third pivotable link to shift said inking device to ink said type face, then said recess engages and then releases said first link means, and then said abutment engages said second link means.

* * * * *